US005318697A

United States Patent [19]

Paspek et al.

[11] Patent Number: 5,318,697

[45] Date of Patent: * Jun. 7, 1994

[54] PROCESS FOR UPGRADING HYDROCARBONACEOUS MATERIALS

[75] Inventors: Stephen C. Paspek, North Royalton; Jeffrey B. Hauser, Middleburgh Hts.; Christopher P. Eppig, Cleveland Hts.; Harry A. Adams, Bedford, all of Ohio

[73] Assignee: The Standard Oil Company

[ * ] Notice: The portion of the term of this patent subsequent to Nov. 26, 2008 has been disclaimed.

[21] Appl. No.: 947,378

[22] Filed: Sep. 18, 1992

Related U.S. Application Data

[63] Continuation of Ser. No. 482,304, Feb. 20, 1990, abandoned.

[51] Int. Cl.[5] ..... C10G 9/26; C10G 9/42

[52] U.S. Cl. ..... 208/132; 208/106; 208/125; 208/130; 208/48 R; 208/255; 208/299

[58] Field of Search ..... 208/131, 132, 125

[56] References Cited

U.S. PATENT DOCUMENTS

| | | | |
|---|---|---|---|
| 2,271,097 | 1/1942 | Ruthruff et al. | 196/49 |
| 2,428,666 | 10/1947 | Hemminger | 208/132 |
| 2,743,214 | 4/1956 | Guernsey | 208/141 |
| 2,847,359 | 8/1956 | Beuther et al. | 208/132 |
| 2,900,327 | 8/1958 | Beuther | 208/132 |
| 3,172,840 | 3/1965 | Paterson | 208/79 |
| 3,369,994 | 2/1968 | Slater et al. | 208/132 |
| 3,586,838 | 5/1971 | Lutz | 208/132 |
| 4,042,487 | 8/1977 | Seguchi et al. | 208/132 |
| 4,057,490 | 11/1977 | Wynne, Jr. | 208/132 |
| 4,080,285 | 3/1978 | McKinney et al. | 208/132 |
| 4,213,846 | 7/1980 | Sooter et al. | 208/50 |
| 4,298,455 | 11/1981 | Huang | 208/48 AA |
| 4,547,284 | 10/1985 | Sze et al. | 208/50 |
| 4,587,007 | 5/1986 | Rudnick | 208/107 |
| 4,604,186 | 8/1986 | Lutz et al. | 208/50 |
| 4,663,019 | 5/1987 | Gartside et al. | 208/50 |
| 4,743,357 | 5/1988 | Patel et al. | 208/113 |
| 4,784,746 | 11/1988 | Farcasiu et al. | 208/106 |
| 4,828,678 | 5/1989 | Venkat et al. | 208/111 |
| 4,836,909 | 6/1989 | Matsuo et al. | 208/72 |
| 4,840,725 | 6/1989 | Paspek | 208/130 |
| 4,869,804 | 9/1989 | Le Perchec et al. | 208/106 |
| 4,877,513 | 10/1984 | Haire et al. | 208/132 |
| 5,068,027 | 11/1991 | Paspek et al. | 208/128 |

OTHER PUBLICATIONS

EPO Search Report for Application 91308040.4, dated May 14, 1992.

*Primary Examiner*—Helane Myers

*Attorney, Agent, or Firm*—David J. Untener; Michael F. Esposito

[57] ABSTRACT

This invention relates to a process for upgrading a hydrocarbonaceous material to a product having a lower boiling point than the initial boiling point of said hydrocarbonaceous material and/or a higher boiling point than the final boiling point of said hydrocarbonaceous material, the process comprising heating a feed composition comprising said hydrocarbonaceous material in an enclosed space in the absence of externally supplied water or hydrogen at a temperature in the range of about 750° F. to about 1300° F. and a pressure sufficient to maintain the specific gravity of the contents of said enclosed space in the range of about 0.05 to about 1.5 for an effective period of time to yield said product, said feed composition being characterized by the absence of aromatic compounds with boiling points at atmospheric pressure below about 350° F.

33 Claims, No Drawings

PROCESS FOR UPGRADING HYDROCARBONACEOUS MATERIALS

This is a continuation of co-pending application Ser. No. 07/482,304 filed on Feb. 20, 1990, now abandoned.

TECHNICAL FIELD

This invention relates to a process for upgrading hydrocarbonaceous materials to lower and/or higher boiling materials.

BACKGROUND OF THE INVENTION

In many delayed coking processes heavy gas oil boiling in the range of about 625° F. to about 900° F. at atmospheric pressure is the heaviest liquid drawn off the coker fractionator. This material is usually subjected to treatment in fluid catalytic crackers for conversion to lighter products. However, due to the refractory nature of heavy gas oil, treatment of such material in such fluid catalytic crackers is often harmful to the catalysts used therein. The detrimental affect on the catalysts affects not only the heavy gas oil being treated in the fluid catalytic cracker, but also other refinery streams that may be co-fed to the cracker. The practice of cracking heavy gas oil in fluid catalytic crackers continues to be a significant practice in many refineries due to the lack of other reliable options available to such refineries. It would be advantageous if a process could be developed for upgrading heavy gas oil as well as similar hydrocarbonaceous materials without having to do so in a fluid catalytic cracker.

U.S. Pat. No. 2,271,097 discloses a process for converting high boiling hydrocarbons into lower boiling hydrocarbons. The process includes the step of heating the bottoms from a fractionator in a viscosity breaker at a temperature of 850°–950° F. and a pressure of 75–500 psig.

U.S. Pat. No. 3,172,840 discloses a process for converting hydrocarbonaceous materials such as petroleum oils to gasoline and middle distillates. The process includes the step of cracking a product stream boiling in the range of 750°–950° F. from a coker bubble tower in a thermal cracking furnace at a temperature of 850°–1000° F. and a pressure of 300–1000 psig.

U.S. Pat. No. 4,213,846 discloses a delayed coking process that employs a hydrotreating step wherein gas oil from the coker fractionator is hydrotreated at a temperature of 315°–400° C. (599°–752° F.) and a hydrogen partial pressure of 350–2000 psig.

U.S. Pat. No. 4,784,746 discloses a process for upgrading crude oil (whole crude or topped crude) by combining the crude oil with a low boiling component that boils below 330° F. and has an aromatic content of at least 20%, then heating the resulting mixture at 400°–500° C. (752°–932° F.) and a pressure sufficient to maintain the feed stream in the liquid phase. The reference discloses pressures in the range of 100–1000 psig. The process is conducted for an effective period of time to increase the proportion of non-residual components in the crude oil using a transalkylation process.

U.S. Pat. No. 4,840,725 discloses a process for converting high boiling hydrocarbons to lower boiling materials characterized by an increase in aromatic content and a lower pour point which comprises contacting said high boiling hydrocarbons with water at a temperature of from about 600° F. to about 875° F. and a pressure of at least about 2000 psi in the absence of any externally supplied catalysts, and wherein the weight ratio of water to high boiling hydrocarbons is from about 0.5:1 to about 1:1, and the water and high boiling hydrocarbon form a substantially single phase system under the elevated temperature and pressure conditions used.

SUMMARY OF THE INVENTION

This invention relates to a process for upgrading a hydrocarbonaceous material to a product having a lower boiling point than the initial boiling point of said hydrocarbonaceous material and/or a higher boiling point than the final boiling point of said hydrocarbonaceous material, the process comprising heating a feed composition comprising said hydrocarbonaceous material in an enclosed space in the absence of externally supplied water or hydrogen at a temperature in the range of about 750° F. to about 1300° F. and a pressure sufficient to maintain the specific gravity of the contents of said enclosed space in the range of about 0.05 to about 1.5 for an effective period of time to yield said product, said feed composition being characterized by the absence of aromatic compounds with boiling points at atmospheric pressure below about 350° F.

DESCRIPTION OF THE PREFERRED EMBODIMENTS

It has now been found that hydrocarbonaceous materials can be upgraded to valuable low and/or high boiling products by subjecting such hydrocarbonaceous materials to heat treatment in a relatively narrow temperature range under sufficient pressure to maintain the density of the reactants and resulting upgraded products at a relatively high level until the desired level of reaction is complete.

The hydrocarbonaceous materials that can be subjected to the inventive process include, for example, light gas oil, heavy gas oil, residual oil (e.g., petroleum oil fractions), decanted oil from fluid catalytic crackers, bitumen, and other light or heavy hydrocarbon oils. The hydrocarbonaceous materials can be aliphatic, alicyclic, aromatic or a mixture thereof and are characterized by the absence of aromatic compounds boiling below about 350° F. at atmospheric pressure. In one embodiment of the invention the initial boiling point of the hydrocarbonaceous material at atmospheric pressure is at least about 350° F.; in another embodiment it is at least about 400° F.; in another embodiment it is at least about 600° F.; in another embodiment it is at least about 800° F.; and in another embodiment it is at least about 900° F. In one embodiment, the hydrocarbonaceous material has an initial boiling point at atmospheric pressure in the range of about 350° F. to about 500° F. and a final boiling point at atmospheric pressure in the range of about 450° F. to about 700° F. In another embodiment the hydrocarbonaceous material has an initial boiling point at atmospheric pressure in the range of about 450° F. to about 750° F. and a final boiling point at atmospheric pressure in the range of about 700° F. to about 1000° F. In another embodiment the hydrocarbonaceous material has an initial boiling point at atmospheric pressure in the range of about 700° F. to about 950° F. and a final boiling point at atmospheric pressure in the range of about 900° F. to about 1100° F. In another embodiment the hydrocarbonaceous material has an initial boiling point at atmospheric pressure in the range of 750° F. to about 1100° F. and no final boiling point; that is, at least some of the hydrocarbonaceous material treated in this embodiment of the invention does not boil. In one embodiment the hydrocarbonaceous material is other than crude oil, e.g., whole or topped crude oil.

The feed composition that is treated in accordance with the inventive method is characterized by the absence of aromatic compounds boiling below about 350° F. at atmospheric pressure. The inventive process is carried out in the absence of externally supplied water or hydrogen. In one embodiment of the invention, the inventive process is carried out in the absence of externally supplied catalysts.

The operating temperature is preferably in the range of about 750° F. to about 1300° F., more preferably about 850° F. to about 1100° F., more preferably about 875° F. to about 1025° F.

The operating pressure is preferably at least about 250 psig, more preferably at least about 450 psig, more preferably at least about 750 psig, more preferably at least about 1000 psig, more preferably at least about 1200 psig, more preferably at least about 1500 psig. A practical upper limit on pressure is about 10,000 psig, and upper limits of about 6000 psig, more preferably about 4000 psig are useful. While pressures in the range of about 250 psig to about 1000 psig can be used, pressures in excess of about11000 psig are preferred. The reaction is typically conducted at pressures in the range of about 1200 to about 4000 psig, more preferably about 1500 to about 3000 psig.

An important and critical feature of the invention is that the operating pressure must be sufficient to maintain the specific gravity of the reactor contents (i.e., feed and converted product) in the range of about 0.05 to about 1.5, more preferably about 0.1 to about 1.2, more preferably about 0.1 to about 1, more preferably about 0.2 to about 0.8, more preferably about 0.3 to about 0.6. In a reactor wherein more than one phase is present (e.g., liquid and gas) the foregoing figures refer to the specific gravity of the lowest-density phase (e.g., gaseous phase in a two-phase system consisting of liquid and gas). In a reactor wherein the pressure is maintained at a constant or substantially constant level (e.g., flow-through reactor) there is a tendency for the specific gravity of the reactor contents to decrease as the reaction progresses, and in such a reactor it is preferred that the specific gravity of the reactor contents be maintained in the foregoing ranges at or near the reactor exit. In one embodiment of the invention, the specific gravity is maintained at a sufficient level to maintain at least part and, preferably all or substantially all, of the reactor contents in liquid phase.

The specific gravity of the reactor contents can be measured using known techniques. For example, flow from the reactor can be diverted to a tube having a fixed volume; the tube is cooled and weighed and the specific gravity is calculated from this measurement.

The reaction is conducted generally for a period of time which is sufficient to provide the desired conversion of the hydrocarbonaceous material to low and/or high boiling materials. The time of the reaction will, of course, vary depending upon the temperature, pressure and the specific hydrocarbonaceous material being treated. For example, at the lower temperatures and pressures, the reaction time will be longer whereas at the higher temperatures and pressures, the time required to obtain the desired conversion is reduced. The three factors of temperature, pressure and time can be varied as determined by one skilled in the art. Depending on these factors, the reaction time may be as short as a few seconds, more generally from about one minute to about one hour. In one embodiment, the reaction time is up to about 10 minutes, preferably from about 1 to about 10 minutes.

The process of the invention can be conducted either as a batch, semi-batch or continuous process. When a batch process is utilized, the hydrocarbonaceous material is added to a reaction vessel such as an autoclave. The autoclave then is sealed and heated to the desired operating temperature and pressure, and when the operating temperature and pressure are reached, they are maintained for the allotted period of time to effect the desired degree of reaction. Generally, a period of from about one minute to about one hour, more preferably about one to about 10 minutes, is adequate to provide the desired degree of conversion to high and/or low boiling materials. The reactor then is cooled, for example, to room temperature, the pressure is released and the reactor is emptied. The desired low and/or high boiling fractions can be isolated and recovered using known techniques such as by distillation or by chromatographic techniques. A semi-batch process is similar to a batch process except that at least some of the product is removed from the reactor on a continuous or semi-continuous basis as it is generated, and/or at least some of the feed composition enters the reactor on a continuous or semi-continuous basis.

When a continuous process is utilized, the reaction product obtained from the reactor is collected and the desired low and/or high boiling fractions are isolated and separated. The product or parts thereof, such as desired boiling fractions, can be recycled to the reactor where the recycled material is, in effect, subjected to a second thermal treatment, and further conversion and recovery of desirable low and/or high boiling materials is achieved.

In one embodiment of the invention, the hydrocarbonaceous material being treated is mixed with at least one organic solvent to improve the handling (e.g., pumping) characteristics of the hydrocarbonaceous material, reduce coke formation in the final product, and/or improve selectivity in the final product to desired low-boiling fractions. Mixing of the hydrocarbonaceous material and solvent can be effected prior to and/or during treatment. Thus, for example, if a flow-through reactor is used, the solvent can be mixed with the hydrocarbonaceous feed material prior to entry into the reactor; or part of the solvent can be mixed with the feed prior to entry into the reactor and part can be added to the reactor contents at one or more entry points along the length of the reactor; or all of the solvent can be added at one or more entry points along the length of the reactor. While the use of such solvent is optional for hydrocarbonaceous feed materials that exhibit relatively low viscosities (e.g., light gas oil boiling at atmospheric pressure in the range of about 350° F. to about 600° F., heavy gas oil boiling at atmospheric pressure in the range of about 600° F. to about 900° F., etc.) it is preferred to use such solvent with feed materials having relatively high viscosities (e.g., bitumen fractions boiling at temperatures above about 1000° F. at atmospheric pressure ). The solvent is preferably capable of dissolving at least about 10 parts of said hydrocarbonaceous material being treated per million parts of solvent at the temperature wherein at least about 50% by weight of said solvent boils at atmospheric pressure. The solvent is characterized by the absence of aromatic compounds boiling below about 350° F. at atmospheric pressure. In one embodiment of the invention, the solvent has an initial boiling point at atmospheric pressure of at least about 350° F., and preferably boils at atmospheric pressure in the range of about 350° F. to about 1000° F., more preferably about 350° F. to about 700° F. The solvent can be aliphatic, alicyclic, aromatic, aliphatic- and/or alicyclic-substituted aromatic, or aromatic-substituted aliphatic or alicyclic. Hydrocarbons that are substituted with non-hydrocarbon groups (e.g., halo, hydroxy, nitro, cyano, alkoxy, acyl, etc.) can be used. Hydrocarbons containing hetero atoms (e.g., nitrogen, oxygen, sulfur) in a chain or ring are useful. Examples of useful solvents include: alkyl-substituted benzenes having boiling points at atmospheric pressure in excess of about 350° F.; naphthalene; anthracene; middle distillates such as fuel oil, gas oil, kerosene and the like; aliphatic and alicyclic compounds of about 10 to about 30 carbon atoms, and in some instances about 12 to about 20 carbon atoms, etc. The solvent can be a readily available refinery stream or fraction therefrom (e.g., heavy reformate) having an initial boiling point at atmospheric pressure above about 350° F. The weight ratio of solvent to hydrocarbonaceous material being treated preferably ranges up to about 1:1. The weight ratio of solvent to such hydrocarbonaceous material can range from about 0.001:1 to about 1:1, more preferably about 0.1:1 to about 0.4:1.

In one embodiment of the invention the hydrocarbonaceous material being treated is mixed with an effective amount of at least one aliphatic or alicyclic unsaturated organic material to increase the yield of low-boiling products. Such mixing can be effected prior to and/or during treatment. Thus, for example, if a flow-through reactor is used, the unsaturated material can be mixed with hydrocarbonaceous feed prior to entry into the reactor; or part of the unsaturated material can be mixed with the feed prior to entry into the reactor and part can be added to the reactor contents at one or more entry points along the length of the reactor; or all of the unsaturated material can be added at one or more entry points along the length of the reactor. The aliphatic or alicyclic unsaturated organic material can be monounsaturated or polyunsaturated (e.g., diolefins, triolefins, etc.). The unsaturation can be ethylenic (—C=C—) or acetylenic (—C≡C—), although ethylenic unsaturation is preferred. These aliphatic or alicyclic materials can be pure hydrocarbons or they can be substituted hydrocarbons. The substituted hydrocarbons are hydrocarbon compounds containing non-hydrocarbon groups (e.g., halo, hydroxy, nitro, cyano, alkoxy, acyl, etc.). Hydrocarbons containing hetero atoms (e.g., nitrogen, oxygen, sulfur) in a chain or ring are useful. The aliphatic or alicyclic materials preferably have final boiling points at atmospheric pressure of up to about 1000° F., more preferably up to about 700° F. Typically these materials contain from 2 to about 50 carbon atoms, more preferably 2 to about 30 carbon atoms, more preferably 2 to about 10 carbon atoms. Examples include ethylene, propylene, 1-butene, 1-pentene, 1-hexene, 1-heptene, 1-octene, 1-nonene, 1-decene, cis-2-butene, trans-2-butene, isobutylene, cis-2-pentene, trans-2-pentene, 3-methyl-1-butene, 2-methyl-2-butene, 2,3-dimethyl-2-butene, etc. The unsaturated material can be a readily available refinery stream or fraction therefrom (e.g., a pyrolysis product stream). The weight ratio of said aliphatic or alicyclic material to the hydrocarbonaceous material being treated preferably ranges up to about 1:1. The weight ratio of aliphatic or alicyclic material such hydrocarbonaceous material can range from about 0.01:1 to about 1:1, more preferably about 0.05:1 to about 0.3:1.

The process of the present invention has a number of advantages over the prior art. The process produces desirable low and/or high boiling products under relatively mild conditions. The amount of coke produced inside the reactor as the result of the process of the invention is reduced. The reduction of coke formation is a significant benefit since coke tends to foul conventional reactors, and where coke is produced, the reactors must be shut down regularly and cleaned. The reduction in the amount of coke formed means that these reactors are capable of being operated continuously for longer periods.

The inventive process is useful in that it produces product boiling below the initial boiling point of the feed and/or product boiling above the final boiling point of the feed. The former is useful in providing lighter, more useful hydrocarbon fractions such as fuel range liquids. The latter is useful in providing useful products such as premium needle coke.

The inventive process is also useful in that it produces a product having a relatively low olefin content. The low olefin content of such product provides it with stability in that the formation of polymers, gums, sludges, color bodies, etc., in said product is eliminated or minimized. In one embodiment of the invention the product produced by the inventive process has an olefin content of preferably less than about 5% by weight, more preferably less than about 2% by weight, more preferably less than about 1% by weight.

The following examples are illustrative of the process of the present invention. Unless otherwise indicated, in the following examples as well as throughout the entire specification and in the appended claims, all parts and percentages are by weight, all boiling points are at atmospheric pressure, and all temperatures are in degrees Fahrenheit. Also, unless otherwise indicated, all specific gravities refer to the density of the materials for which the specific gravity is expressed, divided by the density of water at 4° C.

EXAMPLE 1

3.6 grams of heavy gas oil boiling in the range of 625°–900° F. are placed in a 12 cc stainless steel reactor. The reactor is purged with nitrogen, sealed and immersed in a fluidized sand bath. The temperature of the sand bath is 932° F. The reactor temperature increases to 932° F. in 4–5 minutes. The reactor is maintained at 932° F. under autogeneous pressure for an additional three minutes. The specific gravity of the reactor contents is 0.3. The reactor is removed from the sand bath and quenched. The reactor contents are analyzed, the results being reported in Table I. Gas and coke yields are determined gravimetrically. Oil composition is determined using simulated distillation on a capillary gas chromatograph.

TABLE I

| | Wt. % |
|---|---|
| Gas ($C_1$–$C_4$) | 6 |
| Naphtha (IBP–380° F.) | 24 |
| Kerosine (380–520° F.) | 16 |
| Gas oil (520–700° F.) | 24 |
| Gas oil (700–1000° F.) | 23 |
| Residual oil (1000° F.+) | 6 |

TABLE I-continued

| | Wt. % |
|---|---|
| Coke | 0.3 |

EXAMPLE 2

3.6 grams of heavy gas oil boiling in the range of 625°-900° F. are heated for five minutes under autogeneous pressure at 932° F. in a 12 cc tubing bomb reactor. The specific gravity of the reactor contents is 0.3. The reactor contents are analyzed using the same techniques as in Example 1. The results are reported in Table II.

TABLE II

| | Wt. % |
|---|---|
| Gas | 8 |
| Light liquids (IBP-625° F.) | 58 |
| Heavy liquids (625° F.+) | 34 |
| Coke | nil |

EXAMPLE 3

A flow system having a feed pump, flow through preheater-reactor, and product collection vessel is set up for converting a hydrocarbonaceous feed material to lower and/or higher boiling materials. The feed pump is a dual barrel syringe pump having a rating of 5000 psig, flow rates being variable from 1 to 15 cc/minute. The feed is delivered to the pump from a ten-gallon feed tank under a nitrogen pressure of 25 psig. The preheater-reactor is a continuous coil of ¼ inch 316 stainless steel tubing immersed in a fluidized sand bath. Reactor volumes are varied from 20 to 100 cc by changing the length of the tubing. The product collection vessel is a one-liter autoclave. A water-cooled heat exchanger is positioned between the preheater-reactor and the product collection vessel to cool product flowing from the preheater-reactor to the product collection vessel. The product collection vessel is pre-pressurized with nitrogen to the reaction pressure prior to the start of a run. As liquid accumulates in the product collection vessel, nitrogen is displaced through a back pressure regulator. Gases are measured through a dry test meter. Liquid samples are periodically withdrawn from the bottom of the product collection vessel.

In operation, the system is pre-pressurized with nitrogen to the operating pressure. The sand bath is brought up to the operating temperature. The feed pump is charged with the feed material and started. A pre-run of 200-500 cc is conducted, then the product collection vessel is drained, and the recovery run is commenced. After the contents of one barrel of the syringe pump are fed to the reactor, the second barrel is brought on line, and the first barrel is refilled. At the end of the recovery run, the product receiver is drained, and the dry test meter and syringe pump readings are noted. Product oil conversion is measured gravimetrically. The system is depressurized and residual oil is blown from the preheater-reactor coil with nitrogen. The coil is removed from the sand bath, cooled and weighed to determine coke yield.

Using the foregoing apparatus and procedure, a series of test runs is conducted using heavy gas oil boiling at atmospheric pressure in the range of 625°-900° F. The yield of light oil boiling at atmospheric pressure below 625° F., as well as the operating temperature and time for each test run are reported in Table III. The specific gravity of the contents of the preheater-reactor coil at the exit of said preheater-reactor coil for each of test runs A-P reported in Table III is 0.3-0.6. The yield of light oil is expressed in terms of weight percent based on the weight of heavy gas oil fed to the system. The time reported in Table III is the space time of feed and converted product in the preheater-reactor coil. All test runs are conducted at 2100 psig.

TABLE III

| Test Run | A | B | C | D | E | F |
|---|---|---|---|---|---|---|
| Temp., °F. | 941 | 941 | 941 | 941 | 950 | 950 |
| Time, min. | 6.25 | 7.25 | 9.5 | 9.5 | 2.75 | 3.75 |
| Yield of <625° F. oil, wt. % | 52 | 56 | 58 | 59 | 48 | 56 |

| Test Run | G | H | I | J | K | L |
|---|---|---|---|---|---|---|
| Temp., °F. | 950 | 950 | 968 | 968 | 968 | 968 |
| Time, min. | 4.75 | 6.25 | 1.25 | 1.75 | 2.25 | 2.5 |
| Yield of <625° F. oil, wt. % | 56 | 57 | 39 | 46 | 53 | 58 |

| Test Run | M | N | O | P |
|---|---|---|---|---|
| Temp., °F. | 968 | 1004 | 1004 | 1004 |
| Time, min. | 3.0 | 1.25 | 1.5 | 2.25 |
| Yield of <625° F. oil, wt. % | 58 | 47 | 51 | 57 |

EXAMPLE 4

A series of tests is conducted using heavy gas oil boiling at 625°-900° F. at atmospheric pressure and the same apparatus and procedure as in Example 3. The yield of light oil boiling at atmospheric pressure below 625° F., as well as the temperature for each test run are reported in Table IV. The space time of the feed and converted products in the preheater-reactor for each test run is 5.1 minutes. All test runs are conducted at 2100 psig. The specific gravity of the contents of the preheater-reactor coil at the exit of said preheater-reactor coil for each of test runs A-C reported in Table IV is 0.3-0.5.

TABLE IV

| Test Run | A | B | C |
|---|---|---|---|
| Temp., °F. | 950 | 968 | 986 |
| Yield of <625° F. oil, wt. % | 43 | 49 | 52 |

EXAMPLE 5

A series of tests is conducted using heavy gas oil boiling at atmospheric pressure at 625°-900° F. and the same apparatus and procedure as in Example 3. The yield of light oil boiling at atmospheric pressure below 625° F. as well as the operating pressure for each test run are reported in Table V. The specific gravity of the contents of the preheater-reactor coil at the exit of said preheater-reactor coil for each test run is reported in Table V. The temperature for each test run is 968° F., and the space time of feed and converted product in the preheater-reactor for each run is 2.5 minutes.

TABLE V

| Test Run | A | B | C | D | E | F |
|---|---|---|---|---|---|---|
| Pressure, psig | 250 | 500 | 1000 | 1500 | 2100 | 3100 |
| Specific gravity | 0.1 | 0.15-0.25 | 0.35-0.45 | 0.4-0.5 | 0.45-0.55 | 0.5-0.6 |

TABLE V-continued

| Test Run | A | B | C | D | E | F |
|---|---|---|---|---|---|---|
| Yield of <625° F. oil, wt. % | 47 | 48 | 51 | 52 | 58 | 57 |

EXAMPLE 6

A series of tests is conducted for the purpose of illustrating that "unreacted" heavy gas oil boiling at atmospheric pressure in the range of 625° F. to 900° F. that is subjected to an initial treatment in accordance with the inventive process can be recycled. The same apparatus and procedure as in Example 3 is used. Heavy gas oil boiling at atmospheric pressure in the range of 625° F. to 900° F. is advanced through the preheater-reactor at a temperature of 968° F. and a pressure of 2000 psig. The space time of feed and converted product in the preheater-reactor coil is 3.6 minutes. The resulting product is collected and the portions of such product boiling at atmospheric pressure below 625° F. and above 900° F. are stripped away, leaving the remaining "unreacted" material boiling at atmospheric pressure in the range of 625° F. to 900° F. 420 grams of "unreacted" material are mixed with 1080 grams of heavy gas oil boiling at atmospheric pressure in the range of 625° F. to 900° F. that have not previously been treated in accordance with the inventive process. The mixture is advanced through the preheater-reactor at a temperature of 968° F. and a pressure of 2000 psig. The conversion of the mixture to light oil boiling at atmospheric pressure below 625° F. as well as the space time of feed and converted product in the preheater-reactor coil are reported in Table VI. The specific gravity of the contents of the preheater-reactor coil at the exit of said preheater reactor coil for each of test runs A–D reported in Table VI is 0.4–0.5.

TABLE VI

| Test Run | A | B | C | D |
|---|---|---|---|---|
| Time, min. | 2.1 | 2.5 | 2.9 | 3.8 |
| Conversion to <625° F. oil, wt. % | 35 | 40 | 38 | 40 |

EXAMPLE 7

A series of tests is conducted using a bottoms product and the apparatus and procedure of Example 3. The bottoms product has an initial boiling point at atmospheric pressure of 750° F. and 5% by weight of it boils below 1000° F., the remainder boils at atmospheric pressure above 1000° F. The bottoms product has an aromatic content of 3% by mole, and an aliphatic content of 97% by mole. The temperature for each test run is 968° F. The operating pressure, space time in the preheater-reactor coil and the conversion to oil boiling at atmospheric pressure below 1000° F. are reported in Table VII. The specific gravity of the contents of the preheater-reactor coil at the exit of said preheater-reactor coil for each test run is reported in Table VII.

TABLE VII

| Test Run | A | B | C | D | E | F |
|---|---|---|---|---|---|---|
| Pressure, psig | 2700 | 2700 | 2700 | 2700 | 500 | 475 |
| Time, min. | 2.9 | 3.6 | 4.4 | 5.9 | 2.8 | 4.1 |
| Specific gravity | 0.5–0.6 | 0.5–0.6 | 0.5–0.6 | 0.5–0.6 | 0.1–0.2 | 0.1–0.2 |
| Conversion to | 38.3 | 37.2 | 43.6 | 50 | 45.7 | 71.3 |

TABLE VII-continued

| Test Run | A | B | C | D | E | F |
|---|---|---|---|---|---|---|
| −1000° F. oil, wt. % | | | | | | |

EXAMPLE 8

A series of tests is conducted using decanted oil from a fluid catalytic cracker and the apparatus and procedure of Example 3. The decanted oil has an initial boiling point at atmospheric pressure of 500° F. 50% by weight of the oil boils at atmospheric pressure below 805° F., and the final boiling point of the oil at atmospheric pressure is 1000° F. This decanted oil has an aromatic content of 29% by mole, and an aliphatic content of 71% by mole. The operating pressure for each run is 2500 psig. The space time in the preheater-reactor coil for each run is 5 minutes. The specific gravity of the contents of the preheater-reactor coil at the exit of said preheater-reactor coil is 0.4–0.5. The temperature for each run and the yield of liquid product boiling at atmospheric pressure above 1000° F. are reported in Table VIII.

TABLE VIII

| Test Run | A | B | C | D |
|---|---|---|---|---|
| Temp., °F. | 896 | 950 | 968 | 986 |
| Yield of 1000° F.+ oil, wt. % | 18 | 26 | 25 | 31 |

EXAMPLE 9

A hydrocarbonaceous feed is prepared that consists of a mixture of 90% by weight residual oil having an initial boiling point at atmospheric pressure of 725° F. with 13% by weight boiling at atmospheric pressure in the range of 725°–900° F., the balance boiling at atmospheric pressure at 900° F.+; and 10% by weight n-hexene. The feed is treated in accordance with the inventive process using the apparatus and procedure of Example 3. The temperature is 896° F. and the pressure is 2500 psig. The space time of feed and product in the preheater-reactor coil is five minutes. The specific gravity of the contents of the preheater-reactor coil at the exit of said preheatear-reactor coil is 0.4–0.5. The conversion to product boiling at atmospheric pressure below 900° F. is 64% by weight based on the weight of the residual oil in the feed.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A process for upgrading a hydrocarbonaceous material to a product having a lower boiling point than the initial boiling point of said hydrocarbonaceous material and/or a higher boiling point than the final boiling point of said hydrocarbonaceous material, the process comprising heating a feed composition consisting essentially of said hydrocarbonaceous material in an enclosed space in the absence of externally supplied catalysts, water or hydrogen at a temperature in the range of about 750° F. to about 1300° F. and a pressure of at least 1200 psig for an effective amount of time to yield said product, said pressure being sufficient to maintain the specific gravity of the contents of said enclosed space in the range of about 0.05 to about 1.5, said feed composition being characterized by the absence of aromatic compounds with boiling points at atmospheric pressure below about 350° F.

2. The process of claim 1 wherein said specific gravity is in the range of about 0.1 to about 1.

3. The process of claim 1 wherein said specific gravity is in the range of about 0.2 to about 0.8.

4. The process of claim 1 wherein said specific gravity is in the range of about 0.3 to about 0.6.

5. The process of claim 1 wherein said pressure is in excess of about 1500 psig.

6. The process of claim 1 wherein said pressure is in the range of about 1200 to about 10,000 psig.

7. The process of claim 1 wherein said pressure is in the range of about 1200 to about 6000 psig.

8. The process of claim 1 wherein said pressure is in the range of about 1200 to about 4000 psig.

9. The process of claim 1 wherein said pressure is in the range of about 1500 to about 3000 psig.

10. The process of claim 1 wherein said temperature is in the range of about 850° F. to about 1100° F.

11. The process of claim 1 wherein said temperature is in the range of about 875° F. to about 1025° F.

12. The process of claim 1 wherein said hydrocarbonaceous material comprises light gas oil.

13. The process of claim 1 wherein said hydrocarbonaceous material comprises heavy gas oil.

14. The process of claim 1 wherein said hydrocarbonaceous material comprises residual oil.

15. The process of claim 1 wherein said hydrocarbonaceous material comprises bitumen.

16. The process of claim 1 wherein said hydrocarbonaceous material has an initial boiling point at atmospheric pressure of at least about 350° F.

17. The process of claim 1 wherein said hydrocarbonaceous material has an initial boiling point at atmospheric pressure of at least about 400° F.

18. The process of claim 1 wherein said hydrocarbonaceous material has an initial boiling point at atmospheric pressure of at least about 600° F.

19. The process of claim 1 wherein said hydrocarbonaceous material has an initial boiling point at atmospheric pressure of at least about 800° F.

20. The process of claim 1 wherein said hydrocarbonaceous material has an initial boiling point at atmospheric pressure in the range of about 350° F. to about 500° F. and a final boiling point at atmospheric pressure in the range of about 450° F. to about 700° F.

21. The process of claim 1 wherein said hydrocarbonaceous material has an initial boiling point at atmospheric pressure in the range of about 450° F. to about 750° F. and a final boiling point at atmospheric pressure in the range of about 700° F. to about 1000° F.

22. The process of claim 1 wherein said hydrocarbonaceous material has an initial boiling point at atmospheric pressure in the range of about 700° F. to about 950° F. and a final boiling point at atmospheric pressure in the range of about 900° F. to about 1100° F.

23. The process of claim 1 wherein said hydrocarbonaceous material has an initial boiling point at atmospheric pressure in the range of about 750° F. to about 1100° F. and no final boiling point.

24. The process of claim 1 operated on a batch basis.

25. The process of claim 1 operated on a semi-batch basis.

26. The process of claim 1 operated on a continuous basis.

27. The process of claim 1 wherein said product is removed from said enclosed space and at least part of said product is recycled to said enclosed space.

28. A process for upgrading a hydrocarbonaceous material to a product having a lower boiling point than the initial boiling point of said hydrocarbonaceous material and/or a higher boiling point than the final boiling point of said hydrocarbonaceous material, the process comprising heating a feed composition consisting essentially of said hydrocarbonaceous material in an enclosed space in the absence of externally supplied catalysts, water or hydrogen at a temperature in the range of about 750° F. to about 1300° F. and a pressure in the range of about 1500 to about 3000 psig for an effective period of time to yield said product, said pressure being sufficient to maintain the specific gravity of the contents of said enclosed space in the range of about 0.05 to about 1.5, said feed composition being characterized by the absence of aromatic compounds with boiling points below about 350° F. at atmospheric pressure.

29. A process for upgrading a hydrocarbonaceous material to a product having a lower boiling point than the initial boiling point of said hydrocarbonaceous material and/or a higher boiling point than the final boiling point of said hydrocarbonaceous material, the process comprising heating a feed composition consisting essentially of said hydrocarbonaceous material in an enclosed space in the absence of externally supplied catalysts, water or hydrogen at a temperature in the range of about 750° F. to about 1300° F. and a pressure of about 1200 to about 6000 psig for an effective period of time to yield said product, said pressure being sufficient to maintain the specific gravity of the contents of said enclosed space in the range of about 0.05 to about 1.5, said feed composition being characterized by the absence of aromatic compounds with boiling points below about 350° F. at atmospheric pressure.

30. A process for upgrading a hydrocarbonaceous material other than crude oil to a product having a lower boiling point than the initial boiling point of said hydrocarbonaceous material and/or a higher boiling point than the final boiling point of said hydrocarbonaceous material, the process comprising heating a feed composition consisting essentially of said hydrocarbonaceous material in an enclosed space in the absence of externally supplied catalysts, water or hydrogen at a temperature in the range of about 750° F. to about 1300° F. and a pressure of at least about 1200 psig for an effective amount of time to yield said product, said pressure being sufficient to maintain the specific gravity of the contents of said enclosed space in the range of about 0.05 to about 1.5, said feed composition being characterized by the absence of aromatic compounds with boiling points below about 350° F. at atmospheric pressure.

31. A process for upgrading a hydrocarbonaceous material to a product having a lower boiling point than the initial boiling point of said hydrocarbonaceous material and/or a higher boiling point than the final boiling point of said hydrocarbonaceous material and an olefin content of less than about 5% by weight, the process comprising heating a feed composition consisting essentially of said hydrocarbonaceous material in an enclosed space in the absence of externally supplied catalysts, water or hydrogen at a temperature in the range of about 750° F. to about 1300° F. and a pressure of at least 1200 psig for an effective amount of time to yield said product, said pressure being sufficient to maintain the specific gravity of the contents of said enclosed space in the range of about 0.05 to about 1.5, said feed composition being characterized by the absence of aromatic compounds with boiling points below about 350° F. at atmospheric pressure.

32. A process for upgrading heavy gas oil having a boiling point at atmospheric pressure in the range of about 625° F. to about 900° F. to a product having a lower boiling point than the initial boiling point of said heavy gas oil and/or a higher boiling point than the final boiling point of said heavy gas oil, the process comprising heating a feed composition consisting essentially of said heavy gas oil in an enclosed space in the absence of externally supplied catalysts, water or hydrogen at a temperature in the range of about 750° F. to about 1300° F. and a pressure of at least 1200 psig for an effective amount of time to yield said product, said pressure being sufficient to maintain the specific gravity of the contents of said enclosed space in the range of about 0.05 to about 1.5, said feed composition being characterized by the absence of aromatic compounds with boiling points at atmospheric pressure below about 350° F.

33. A process for upgrading a hydrocarbonaceous material to a product having a lower boiling point than the initial boiling point of said hydrocarbonaceous material and/or a higher boiling point than the final boiling point of said hydrocarbonaceous material, the process comprising heating a feed composition consisting essentially of said hydrocarbonaceous material in an enclosed space in the absence of externally supplied catalysts, water or hydrogen at a temperature in the range of about 750° F. to about 1300° F. and a pressure of at least 1200 psig for an effective amount of time to yield said product, said pressure being sufficient to maintain at least part f the contents of said enclosed space in liquid phase, said feed composition being characterized by the absence of aromatic compounds with boiling points at atmospheric pressure below about 350° F.

* * * * *